United States Patent [19]

Ross

[11] 3,982,659

[45] Sept. 28, 1976

[54] BULK PACKAGE FOR SUBSTANTIALLY WET SHEETS AND DISPENSING DEVICE THEREFOR

[75] Inventor: Richard T. Ross, Aston, Pa.

[73] Assignee: Scott Paper Company, Philadelphia, Pa.

[22] Filed: Dec. 24, 1975

[21] Appl. No.: 644,022

[52] U.S. Cl. ..... 221/63; 221/310

[51] Int. Cl.[2] ..... B65H 1/00

[58] Field of Search ..... 221/63, 47–62, 221/307–310

[56] References Cited

UNITED STATES PATENTS

| | | | |
|---|---|---|---|
| 1,543,865 | 6/1925 | Muchmore | 221/63 |
| 2,619,226 | 11/1952 | Adams | 221/63 |
| 2,640,587 | 6/1953 | Smith | 221/63 X |
| 3,780,908 | 12/1973 | Fitzpatrick et al. | 221/63 X |
| 3,843,017 | 10/1974 | Harrison | 221/63 |

*Primary Examiner*—Allen N. Knowles

*Attorney, Agent, or Firm*—Martin L. Faigus; William J. Foley

[57] ABSTRACT

Dispensing devices employed in a bulk package of substantially wet sheets include a substantially flat section having an opening through which successive sheets are adapted to be individually dispensed. The opening includes curved surfaces which are substantially free of sharp angles and bends to provide spaced lobes. Hingedly connected flexible flaps are normally disposed within the spaced lobes in substantially the same plane as the flat section, and the flaps have substantially curved outer margins which are closely positioned to curved surfaces providing the lobes to form restricting channels into which successive sheets are directed during sheet dispensing. Bulk packages including the above-described dispensing device also form a part of this invention.

13 Claims, 5 Drawing Figures

Fig. 3
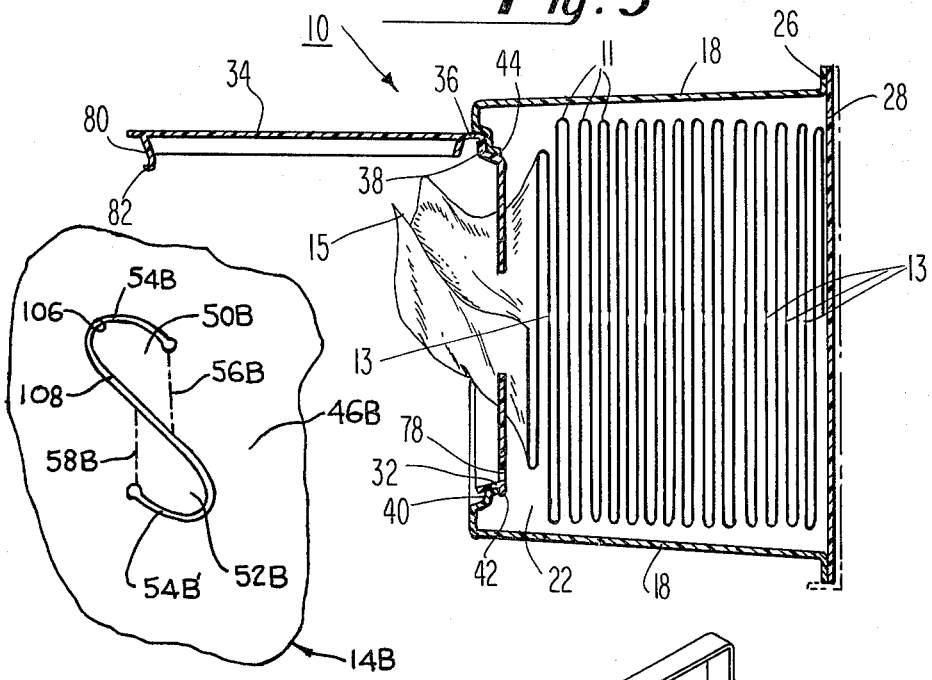
Fig. 5
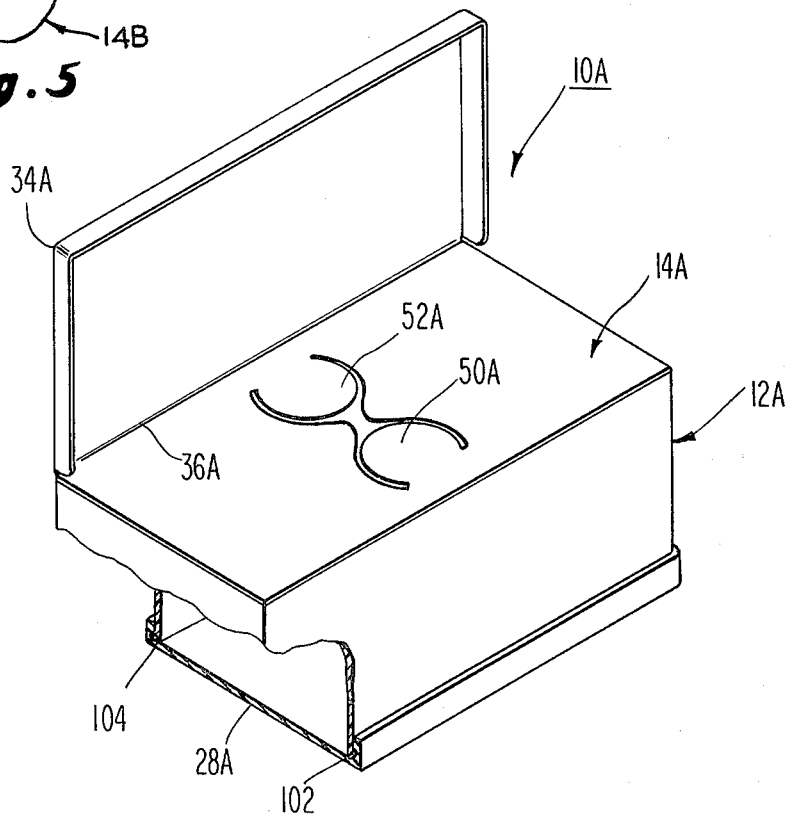
Fig. 4

BULK PACKAGE FOR SUBSTANTIALLY WET SHEETS AND DISPENSING DEVICE THEREFOR

BACKGROUND OF THE INVENTION

1. Field of the Invention

This invention relates to dispensing devices employed in bulk packages of substantially wet sheets, and to bulk packages including said dispensing devices. More particularly, this invention relates to dispensing devices which provide for the individual "pop-up" dispensing of successive sheets, and to bulk packages employing such dispensing devices.

2. Description of the Prior Art

Bulk packages which provide for the individual "pop-up" dispensing of successive wet sheets are known in the prior art. One such package is disclosed in U.S. Pat. No. 3,780,908, issued to Fitzpatrick et al on Dec. 25, 1973. The bulk package disclosed in that patent is presently being sold by International Playtex Company in the form of premoistened feminine towelettes. The dispensing device in the Fitzpatrick et al patent is in the form of a removable insert that includes a diamond-shaped dispensing opening having a fairly large area. This large area opening provides for easy access into the interior of the compartment in the event that a sheet to be dispensed from the compartment is not in its popped-up position. However, the moisturizing ingredients in the sheets can evaporate excessively when a large area dispensing opening is provided. Such excessive evaporation is most likely to occur if a closure of the package is inadvertently left in an opened condition, or is not properly closed to provide an effective moisture-impervious seal about the dispensing opening. If the sheets lose an excessive amount of their moisturizing ingredients they may become unsuitable for their intended function.

A second commercially available bulk package which provides for the pop-up dispensing of premoistened sheets is manufactured by Sterling Drug, Inc., and is sold under the name "Wet-Ones." This package includes a removable lid which closes an open end of a cylindrical container. The lid includes an X-shaped dispensing opening provided by crossing slits which divide the lid into flexible tabs having sharp corners and bends. The premoistened sheets are in the form of a core-less roll positioned in the cylindrical container. Lines of perforations divide the roll into individual sheets, and successive sheets separate from the roll at a line of perforations upon withdrawal of an immediately preceding sheet through the dispensing opening. This separation is intended to take place after the line of perforations has cleared the dispensing opening so that each successive sheet extends partially through the opening for easy dispensing.

A cross-slit arrangement providing the dispensing opening overcomes the problem of excessive moisture evaporation from the contents in the package. However, in the event that a sheet fails to pop up a user cannot easily insert his fingers through the opening to grasp the uppermost sheet and pull it through the opening. In fact, a user can easily cut, or otherwise injure his finger if he attempts to force it past the surfaces of the tabs defining the X-shaped dispensing opening. Accordingly, if a sheet fails to pop-up a user of the package must remove the lid and insert the leading edge of the sheet through the slits from the underside of said lid. In performing this operation the user should take care not to force his fingers through the slits for the reason indicated above. This same insertion operation is required to initially place the packaging system in operation after it has been purchased. This type of an insertion operation is cumbersome, and somewhat difficult.

U.S. Pat. No. 2,640,587, issued to Smith, discloses a dry tissue dispenser which includes a generally hourglass shaped dispensing opening in a wall thereof. The dispenser disclosed in Smith is somewhat nonanalogous to the instant invention in that it is designed for the dispensing of substantially dry sheets without any concern for causing successive sheets to move partially through the opening upon the withdrawal of an immediately preceding sheet. In other words the dispenser disclosed in Smith is not concerned with the "pop-up" dispensing of any sheets from a package.

In summary, bulk packages providing for the pop-up dispensing of substantially wet sheets have either included a relatively large dispensing opening, as disclosed in the Fitzpatrick et al patent, or an extremely narrow slit-type opening, as embodied in the Wet-Ones packaging system sold by Sterling Drug. A relatively large dispensing opening permits the easy retrieval of sheets which fail to pop-up upon the witdrawal of a preceding sheet. However, such a large opening can cause excessive evaporation of the moisturizing ingredients within the sheet in the event that a closure to be sealed about the opening is either left opened, or is improperly sealed. A narrow slit-type opening provided by tabs having sharp corners and bends tends to prevent this excessive evaporation of the moisturizing ingredients from taking place. However, in the event that the dispensing of a sheet fails to pull the leading end of the next succeeding sheet through the opening, said leading end cannot be easily retrieved by inserting the fingers through the opening of the package.

SUMMARY OF THE INVENTION

Reference throughout this application to "wet" or "substantially wet" sheets is intended to refer to sheets so wetted by an aqueous or other desired treatment medium that when they are wiped across a surface said surface is streaked by the liquid medium. In a preferred embodiment of this invention the treatment medium is aqueous, and provides a moisture content of from between about 100% and about 350% by weight based on the dry weight of the sheet. In one commercial embodiment of this invention the sheets are premoistened feminine towelettes.

Reference throughout this application to the "dry weight" of fibers and webs refers to the weight of fibers and webs under equilibrium conditions in an environment of 50% relative humidity and 68°–70°F.

Reference throughout this application to "pop-up" describes a mode of dispensing in which the leading edge of a sheet is pulled through a dispensing opening upon dispensing of an immediately preceding sheet. Preferably the leading edge extends through the opening for a distance of from about ¼ inch to about 1 inch.

As used throughout this application, the terms "sheet" or "sheets" comprehend liquid-holding or similar sheet materials. Preferably the sheets are fiber structures in which a preponderance, by weight, of the fibers are short cellulosic fibers of a papermaking length less than ¼ inch (e.g. woodpulp and cotton linters). The sheets can include 100% of such short cellulosic fibers; however, for some applications it may be desirable to include a minor proportion, by weight, of textile-length fibers greater than ¼ inch in length to reinforce the structure. Preferably the longer textile-length fibers are greater than ½ inch in length and constitute no more than about 30%, by weight, of the fiber composition. Textile-length fibers employed for reinforcing dry-formed webs can include polyester fibers, rayon fibers, or other fibers which are well known in the prior art.

This invention relates to a unique dispensing device employed in a bulk package of substantially wet sheets that are successively interconnected for permitting individual pop-up dispensing of successive wet sheets. The dispensing device includes a substantially flat section having an opening therethrough which is adapted to communicate with the wet sheets, and through which the successive sheets are adapted to be individually dispensed. The opening includes curved surfaces which are substantially free of sharp angles and bends to provide spaced lobes. Hingedly connected flexible flaps are normally disposed within the spaced lobes in substantially the same plane as the flat section, and each flap has a substantially curved outer margin which is substantially free of sharp angles and bends. The outer margins of the flaps are closely positioned to curved surfaces providing the lobes to form restricting channel means into which successive sheets are directed during sheet dispensing. Each of the successive sheets encounters frictional resistance by surfaces of restricting channel means during dispensing of its immediately preceding sheet to separate each successive sheet from its immediately preceding sheet after said immediately preceding sheet has been withdrawn from the package so as to leave a portion of the successive sheet extending through the opening to provide for easy dispensing thereof.

The hingedly connected flexible flaps close off a considerable area of the lobes to prevent excessive evaporation of the treatment material in the event that a closure adapted to be sealed about the dispensing opening is either left opened, or is improperly closed. Moreover, the hinged connection of the flexible flaps permits a user to insert his thumb and forefinger through the fairly large lobes of the dispensing opening by forcing the flaps downwardly about their hinged connections. In this manner a sheet which has failed to pop-up can be easily retrieved by the user of the packaging system.

A bulk package of substantially wet sheets employing the above dispensing device also forms a part of this invention. The bulk package includes a movable closure adapted to provide a moisture-impervious seal about the dispensing opening during periods of storage, and adapted to be moved to permit access to the opening for the dispensing of the wet sheets. The closure can be formed separately from the other members of the package, or can be integrally injection molded as a part of the dispensing device, or as a part of a container body in which the wet sheets are retained.

The dispensing device can be formed in a unit which is separate and apart from the container body in which the wet sheets are retained. In such an embodiment the dispensing device includes retention means for permitting the attachment of said unit to the container body. Alternatively, the dispensing device can be injection molded or otherwise formed as part of the container body in which the wet sheets are retained.

Other objects and advantage of this invention will become apparent upon reading the detailed description which follows, taken in conjunction with the drawings.

BRIEF DESCRIPTION OF THE DRAWINGS

FIG. 3 is a sectional view taken along line 3—3 of FIG. 1;

FIG. 4 is an isometric view of a second embodiment of this invention with parts broken away to show details of construction; and FIG. 5 is a fragmentary plan view of a modified dispensing opening in accordance with this invention.

DESCRIPTION OF THE PREFERRED EMBODIMENTS

Figure 2:
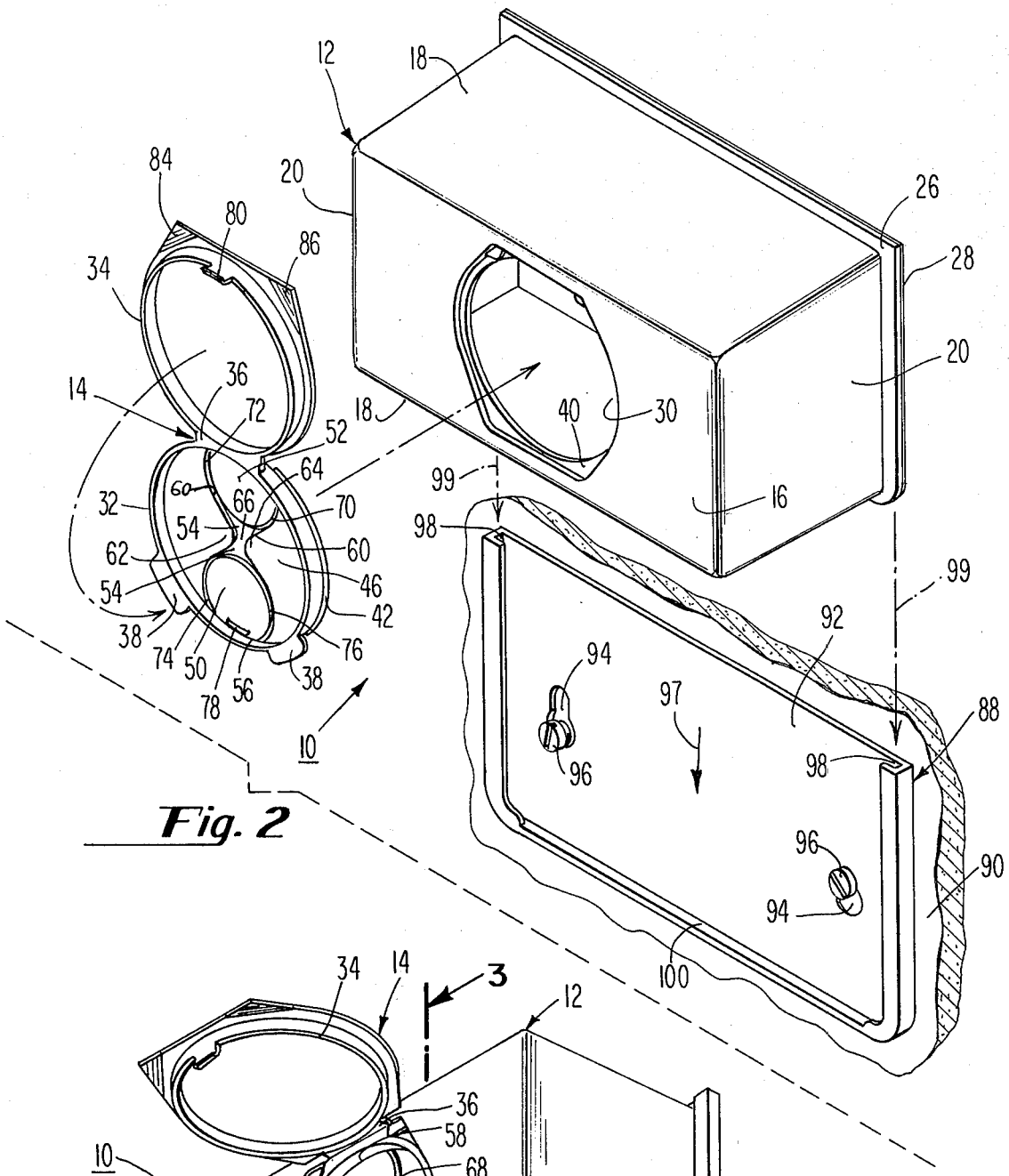
FIG. 2 is an exploded isometric view of the assembly shown in FIG. 1.
Figure 1:
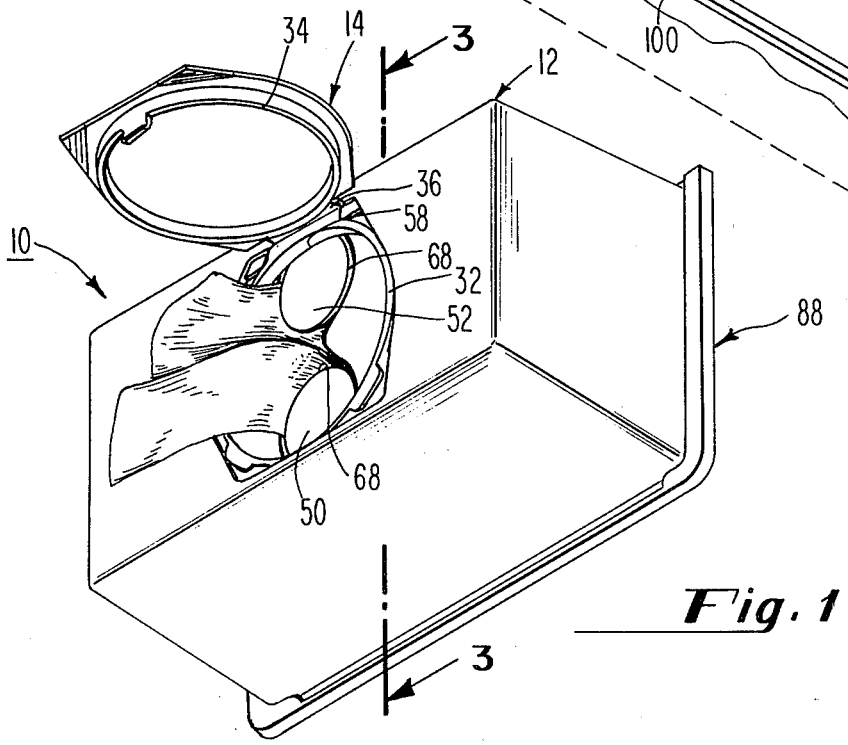
FIG. 1 is an isometric view of a bulk package according to this invention shown in its assembled condition and mounted on a supporting bracket which is adapted to be attached to a wall or other supporting surface.

Referring to FIGS. 1–3, a bulk package 10 for the pop-up dispensing of wet sheets 11 (FIG. 3) includes a container body 12 and a dispensing device 14. The container body 12 includes a front wall 16 and peripheral side and end walls 18 and 20, respectively, to provide a compartment 22 (FIG. 3) for the wet sheets 11. The side and end walls 18 and 20 terminate in a continuous, peripheral flange 26 to which a closure plate 28 is adhered or attached (FIG. 3). Any suitable adhesive or binder which is compatible with the materials of the container body 12 and the closure plate 28 can be employed to adhere said closure plate to the peripheral flange 26. The front wall 16 is provided with an opening 30 in which the dispensing device 14 is adapted to be removably secured.

The dispensing device 14 includes a dispensing section 32 and a closure section 34. This dispensing device is injection molded as a single unit from a suitable flexible plastic material, such as polypropylene, and includes a flexible web section 36 providing a hinge connection between the dispensing section 32 and the closure section 34.

The dispensing device 14 is removably connected to the container body 12 through the cooperation of peripheral flanges on the dispensing section 32 with outer and inner surfaces of the front wall 16 of the container body. Specifically, the dispensing section 32 includes circumferentially spaced peripheral flanges 38 which are adapted to overlie a top surface 40 of the front wall 16, and circumferentially spaced peripheral flanges 42 which are adapted to underlie a lower surface 44 of said front wall (FIGS. 1 and 3). Preferably the flanges 38 are circumferentially offset with respect to the flanges 42. The flanges 38 and 42 are sufficiently flexible so that a user can apply a force to the dispensing device 14 for removing it from the container body 12. However, the securing force between the dispensing device 14 and the container body 12 must be sufficient to prevent frictional forces imposed upon said dispensing device during sheet withdraw from forcing the dispensing device out of engagement with said container body. A person skilled in the art, and knowing that this criteria must be met, can easily design the dimensions and shape of the peripheral flanges 38 and 42 to meet this criteria.

The dispensing section 32 of the dispensing device 14 includes a substantially flat section 46 in which the unique dispensing arrangement of this invention is included. Specifically, the dispensing arrangement includes spaced end flaps 50 and 52 which are spaced from each other and normally disposed within lobes 54 at opposite ends of a substantially hour-glass shaped dispensing opening and in substantially the same plane as the flat section 46. The flaps 50 and 52 are hingedly connected to the dispensing section 32 at hinge lines 56 and 58 respectively (FIGS. 1 and 2). The outer periphery of the hour-glass shaped opening is provided by generally curved, sinuate surfaces 60 which are free of sharp angles and bends. These sinuate surfaces 60 provide transversly spaced tongues 62 and 64 defining a narrow neck region 66 of the opening. This neck region 66 is narrower than, and is disposed intermediate of the spaced lobes 54.

The flaps 50 and 52 include outer margins 68 (FIG. 1) which are substantially free of sharp angles and bends, and these outer margins cooperate with the sinuate surfaces 60 to provide narrow sheet-restricting channels 70, 72, 74 and 76 in communication with the intermediate neck region 66 of the opening. The function of these narrow channels will be described later in connection with the explanation of the operation of the dispensing device 14.

The closure section 34 of the dispensing device is adapted to be retained in a position overlying the dispensing section 32 to provide a substantially moisture-impervious seal about the dispensing opening. To retain the closure section 34 in its sealing position a transversely extending recess 78 interrupts the hinge line 56 of end flap 50, and a latching rib 80 of the closure section 34 is forced through said recess. The latching rib 80 includes an out-turned finger 82 (FIG. 3) which underlies a lower segment of the dispensing section 32 for positively retaining the closure section 34 in its sealing position relative to the dispensing section. This retentive force can be manually defeated by engaging one or both corners 84 and 86 of the closure section 34, and forcing said closure section in a direction opposite to that depicted by the arrow shown in FIG. 2.

Referring to FIGS. 1 and 2, a mounting member 88 is provided to secure the bulk package 10 on a supporting wall 90, or other desired supporting structure. A back wall 92 of the mounting member 88 includes a pair of openings 94 extending through it. Each opening 94 includes a lower section having a greater radius of curvature than an upper section. The mounting member 88 is secured to the supporting wall 90 by first attaching screws 96, or other similar fastening means, into the supporting wall with the head of the screw being spaced from a front surface of said supporting wall. The lower section of each opening 94 is dimensioned to receive the head of the screw therethrough, as shown on the left side of FIG. 2. After the screws 96 have been inserted through the lower end of the openings 92, the mounting member 88 is moved in a downward direction, as indicated by arrow 97, to cause the heads of the screws to overlie surfaces of the back wall 92 which circumscribe the upper section of openings 92. This latter relationship is shown at the right side of FIG. 2. It is understood that a two-sided adhesive tape, or other fastening device, could be employed in place of screws 96 to adhere the mounting member 88 to the supporting wall 90.

The mounting member 88 includes substantially U-shaped channels 98 at opposite ends thereof, and these channels terminate at a bottom wall 100. These U-shaped channels receive end flange sections of the container body, as schematically indicated by the arrows 99 in FIG. 2, and a lower flange section of the container body sits on the bottom wall 100 of the mounting member 88, as shown in FIG. 1. In this manner the bulk package 10 is positively retained on the supporting wall 90, and can be easily removed from that position by sliding it out of engagement with the end channels 98 in a direction opposite to arrows 99.

The bulk package 10 shown in FIGS. 1 through 3 are not specifically designed to receive replacement packages of wet sheets after an initial quantity has been used up. However, it is considered to be within the scope of this invention to provide a packaging system to permit the use of replacement packages, and one such embodiment is shown at 10A in FIG. 4.

Referring to FIG. 4, the bulk package 10A includes a dispensing device 14A which is formed as the top wall of a container body 12A. This dispensing device includes a sheet dispensing arrangement which is the same as dispensing arrangement shown in FIGS. 1–3. In the FIG. 4 embodiment the bottom end of the container body 12A is a removable closure plate 28A which is retained as part of the container body 12A by the mechanical interaction between outwardly extending ribs 102 on the side and end walls of the container body and inwardly directed recesses 104 on the upstanding side and end walls of the closure. This mechanical connection can be manually defeated to permit the closure to be removed for insertion of replacement packages of wet sheets. In the embodiment shown in FIG. 4 a lid 34A is provided which is unitarily injection molded to the container body 12A through a hinge line 36A.

Referring to FIGS. 1 and 3, the manner in which the sequential pop-up dispensing of successive wet sheets is accomplished will now be described. It is understood that the same general mode of operation applies to the packaging system 10A disclosed in FIG. 4.

A pluarality of wet sheets 11 which are to be dispensed from the bulk package 10 are assembled in stacked condition within the interior compartment 22 of container body 12. The sheets shown in FIG. 3 are S-folded, and are temporarily interconnected through tab connections 13. It should be understood that the temporary interconnection between successive wet sheets can be accomplished by interfolding the sheets. When the sheets are interfolded the contacting sections of adjacent sheets in the interfolded region generally provide sufficient frictional interconnection to cause successive sheets to be pulled through the dispensing slot during dispensing of an immediately preceding sheet.

Preferably the sheets 11 are folded so that free edges 15 of successive sheets are in alignment with the narrow neck region 66 of the dispensing opening. In other words, the free edge of successive sheets extends generally perpendicularly to the direction of spacing of the end flaps 50 and 52. To dispense the uppermost sheet the thumb and forefinger are forced against the end flaps 50 and 52 to permit the fingers to enter the relatively wide lobes 54 at opposite ends of the dispensing opening. The thumb and forefinger can then be pinched together so as to engage the free edge 15 of the uppermost sheet which is aligned with the narrow neck region 66, and the fingers can easily be withdrawn from the opening 54 along with the engaged sheet. As the uppermost sheet in the stack is directed through the dispensing opening it is guided by the tongues 62 and 64 into one or more of the restricting channels 70, 72, 74, 76, and the sheet encounters frictional resistance in said channels. However, the channels are dimensioned so that the frictional resistance is not so great as to cause the sheet being dispensed to tear. The fact that the outer margins 68 of the flaps and the outer surfaces 60 of the dispensing opening are substantially free of sharp of angles and bends further insures that the sheet will not become snagged in the opening and thereby tear or otherwise become damaged.

As the uppermost sheet in the stack is pulled through the opening it pulls the next succeeding sheet into the opening as a result of the temporary interconnection between the successive sheets. The tabs 13 are designed to separate upon clearing the opening 54 as a result of the frictional drag imposed on the succeeding sheet in one or more of the restricting channels 70, 72, 74, 76 as the preceding sheet is being dispensed. Accordingly, the succeeding sheet will extend partially through the opening 54 to permit said succeeding sheet to be easily grasped for subsequent withdrawal. This sequential manner of effecting the individual pop-up dispensing of successive wet sheets continues until all of the sheets in the stack have been dispensed.

In the event that a tab interconnection between successive sheets breaks prior to a successive sheet being pulled partially through the dispensing slot, a person can insert his thumb and forefinger through the slot to engage a free edge of the uppermost sheet in the same manner as described earlier. Once a sheet extends partially through the dispensing opening the frictional force imposed upon it by the peripheral surfaces defining the restricting channels 70, 72, 74 and/or 76 prevents it from falling back into the container.

Employing a revmovable dispensing device 14 of the type used in the bulk package 10 is desirable when the container compartment is fairly deep. To further explain, if one of the lower sheets disposed in a fairly deep compartment fails to pop-up, a person may not be able to insert his thumb and forefinger through the flaps to the desired depth for retrieving said sheet. Accordingly, it may be necessary to physically remove the dispensing device 14 to provide a larger area opening into which the fingers can be inserted for grasping a lower sheet.

Referring to FIG. 4, the manner in which the pop-up dispensing of successive sheets is achieved is identical to that described above in connection with FIGS. 1 and 3. However, in the FIG. 4 embodiment the dispensing device 14A is unitarily formed with the container body 12A, and therefore, can not be removed for retrieving a sheet which fails to pop-up during dispensing of its immediately preceding sheet. Accordingly, it is preferred that the interior compartment in which the sheets are disposed be sufficiently shallow to permit the user's fingers to be forced into the dispensing opening through hinged flaps 50A and 52A for retrieving even the lowermost sheet in the stack.

If desired, the lid 34A can be formed as a unitary injection molded part of the container body 12A, as shown in FIG. 4, and the dispensing device 14A can be formed as a removable insert, in a manner similar to that diisclosed in the Fitzpatrick et al patent. In such a construction the insertion of replacement packs will take place through the top, rather than the bottom of the container body, and the bottom of the container body can be unitarily injection molded with the side and end walls of said body.

Referring to FIG. 5, an alternative dispensing device 14B of this invention includes a generally S-shaped dispensing opening formed in a flat section 46B of said device. This opening includes spaced flaps 50B and 52B normally disposed within spaced lobes 54B and 54B' in substantially the same plane as the flat section 46B. The flaps 50B and 52B have a hinge action generally along lines which intersect the ends of the S-shaped opening, as is schematically indicated by phantom lines 56B and 58B.

The S-shaped opening is defined by generally curved surfaces 106 and 108 which are free of sharp angles and bends. The curved surface 106 provides the outer curved surface of lobe 54B and the outer curved margin of flap 52B. The curved surface 108 provides the outer curved surface of lobe 54B' and the outer curved margin of flap 50B. In the dispensing device 14B the S-shaped opening also constitutes restricting channels, and performs the same function as the restricting channels employed in the dispensing devices 14 and 14A.

The manner in which the sequential pop-up dispensing of successive wet sheets is accomplished through the S-shaped opening in dispensing device 14B is substantially the same as that described in connection with the dispensing devices 14 and 14A. The most significant difference is that the hinge lines 56B and 58B are disposed approximately 90° to the orientation of hinge lines 56, 58 and 56A, 58A in the dispensing devices 14 and 14A, respectively, when the long dimension of the openings are disposed in the same direction.

The S-shaped opening of dispensing device 14B can be employed in all variants of dispensing devices described in this application.

Having described my invention I claim:

1. A dispensing device employed in a bulk package of substantially wet sheets which are successively and temporarily interconnected for permitting individual pop-up dispensing of the wet sheets, said dispensing device including:

A. a substantially flat section having an opening therethrough which is adapted to communicate with the sheets, and through which successive sheets are adapted to be individually dispensed, said opening including curved surfaces which are substantially free of sharp angles and bends providing spaced lobes; and B. hingedly connected flexible flaps normally disposed within said lobes in substantially the same plane as the flat section, said flaps having substantially curved outer margins which are substantially free of sharp angles and bends, the outer margins of said flaps being closely positioned to curved surfaces providing the lobes to form restricting channel means into which successive sheets are directed during sheet dispensing, successive sheets encountering frictional resistance by surfaces of restricting channel means during dispensing of immediately preceding sheets to separate a successive sheet from its immediately preceding sheet after said immediately preceding sheet has been withdrawn from the package with a portion of the successive sheet extending through the opening to thereby provide for the easy dispensing of the successive sheet.

2. The dispensing device according to claim 1, wherein said curved surfaces are generally sinuate for providing an intermediate neck region in the opening which connects the spaced lobes and is narrower than said lobes.

3. The dispensing device according to claim 2, wherein the narrow transverse dimension of the neck region is defined by a pair of spaced and opposed inwardly extending tongues forming a part of the substantially flat section, peripheral surfaces of said tongues cooperating with a segment of the outer margin of each flap to provide a central passage in the opening which communicates with each of the restricting channel means.

4. The dispensing device according to claim 3, including a cover member for overlying the opening through the substantially flat section to provide a substantially moisture-impervious seal over said opening.

5. The dispensing device according to claim 4, wherein it is a unitary one-piece member.

6. The dispensing device according to claim 1, wherein the curved surfaces providing the lobes and the outer margins of said flaps cooperate to define a generally S-shaped opening through which the successive sheets are adapted to be individually dispensed.

7. A bulk package for individually dispensing substantially wet sheets from a stack of such sheets, said package comprising:

A. a stack of wet sheets;

B. means for temporarily interconnecting successive sheets within said stack to produce a sheet-to-sheet force resisting separation of successive sheets and to permit partial removal of successive sheets outwardly from the package upon withdrawal of each preceding sheet;

C. a container receiving the stack of wet sheets;

D. a dispensing device including a substantially flat section having an opening therethrough which is in overlying relationship with flat surfaces of the sheets in the stack; and E. a cover member for overlying the opening to provide a seal; the improvement of 1. said opening including curved surfaces which are substantially free of sharp angles and bends providing spaced lobes; and 2. hingedly connected flexible flaps normally disposed within said lobes in substantially the same plane as the flat section of the dispensing device, said flaps having substantially curved outer margins which are substantially free of sharp angles and bends, the outer margins of said flaps being closely positioned to curved surfaces providing the lobes to form restricting channel means into which successive sheets of said stack are directed during sheet dispensing, successive sheets encountering frictional resistance by surfaces of restricting channel means for separating from its immediately preceding sheet with a portion of the next succeeding sheet extending outwardly of the opening for subsequent manual grasping and removal from the package.

8. The bulk package according to claim 7, wherein the curved surfaces of the dispensing device are generally sinuate for providing an intermediate neck region in the opening which connects the spaced lobes and is narrower than said lobes.

9. The bulk package according to claim 8, wherein the narrow dimension of said intermediate neck region is provided by a pair of spaced and opposed tongues which form a part of the substantially flat section, peripheral surfaces of said tongues cooperating with outer margins of the flaps to provide a central passage in the opening communicating with the restricting channel means.

10. The dispensing device according to claim 7, wherein the curved surfaces providing the lobes and the outer margins of said flaps cooperate to define a generally S-shaped opening through with the successive sheets are adapted to be individually dispensed.

11. The bulk package according to claim 7, wherein said dispensing device and cover member constitute a single unit, said container body including an opening through a wall thereof, and said unit including retention means for cooperating with said container body for retaining said unit assembled with said container body when the unit is positioned within the opening in the wall of the container body, said retention means being manually defeatable to permit removal of said unit from said container body but not being defeatable by frictional forces imposed upon it during sheet dispensing.

12. The bulk package according to claim 7, wherein said dispensing device is an injection molded section of the container body.

13. The bulk package according to claim 7, wherein the cover member is hingedly connected to said container body.

* * * * *